United States Patent [19]

Sugiyama

[11] 4,074,430

[45] Feb. 21, 1978

[54] SHEARS

[75] Inventor: Tsuneyoshi Sugiyama, Seki, Japan

[73] Assignee: Feather Kogyo Kabushiki Kaisha, Japan

[21] Appl. No.: 737,984

[22] Filed: Nov. 2, 1976

[30] Foreign Application Priority Data

Jan. 20, 1976 Japan ..... 51-515213

[51] Int. Cl.[2] ..... B26B 13/04

[52] U.S. Cl. ..... 30/260; 30/321

[58] Field of Search ..... 30/237, 239, 254, 257, 30/260, 266, 341, 349, 321

[56] References Cited

U.S. PATENT DOCUMENTS 514,082 2/1894 Kemphaus ..... 30/266 X 869,949 11/1907 Westerdahl ..... 30/257

FOREIGN PATENT DOCUMENTS 349,206 3/1905 France ..... 30/266

*Primary Examiner*—Jimmy C. Peters

*Attorney, Agent, or Firm*—Wenderoth, Lind & Ponack

[57] ABSTRACT

The present invention relates to a shears wherein the handle and the blade part of the shears are separately manufactured and the two blade parts are fitted and secured between two handles by means of a cam mechanism. By operation of the foregoing cam mechanism, the angle between the blade part and the handle can be changed.

3 Claims, 6 Drawing Figures

SHEARS

BACKGROUND OF THE INVENTION

I. Field of the Invention

The present invention belongs to the technical field of sewing, medical treatment. horticulture and handicraft.

II. Description of the Prior Art

As for the prior art to which this invention relates, a shears has formerly been manufactured with the handle and the blade parts being in one piece. Consequently, the angle between the blade part and the handle could not be varied according to the conditions of use. For example, when the cutting of fabric was performed for sewing, this was accomplished by placing the fabric on a horizontal cutting table with the tip of the blade part touching the fabric at an angle of 20° and wherein the tip of the blade part slid along on the said horizontal cutting table while the handle was manipulated.

Consequently, in such a cutting operation as described above, it is difficult to maintain the blade part at a definite angle to the fabric and the cutting table and to do so required a great deal of manual skill. Further, notwithstanding the existence of this skill, it is still difficult to maintain a definite angle during this cutting operation for a long period of time. Moreover, in the field of medical operations, there are cases in which it is very difficult to manipulate the shears when the blade part is arranged horizontally to the handle, especially when the area to be cut is found in a narrow space within the human body. To counteract this difficulty, a plurality of shears have been used, each having varied angles between the blade and the handle, for such operations.

BRIEF SUMMARY OF THE INVENTION

An object of the present invention is to produce a shears of a simple construction which can be manipulated easily and manufactured at a low cost.

A further object of the present invention resides in the production of a shears wherein the angle between the blade and the handle may be varied according to the conditions under which the object is to be cut. This makes it possible to use a single shears for different operations which formerly required a plurality of shears.

Another object herein is the manufacture of a shears which is flexible enough to carry out a satisfactory sewing operation for a long period of time without the necessity of manually maintaining a definite angle between the blade part and the handle, thus eliminating a high degree of skill and dexterity in the cutting operation.

Other objects and advantages of the present invention will become apparent from the discussion of the accompanying drawings.

DESCRIPTION OF THE PREFERRED EMBODIMENTS

Figure 1:
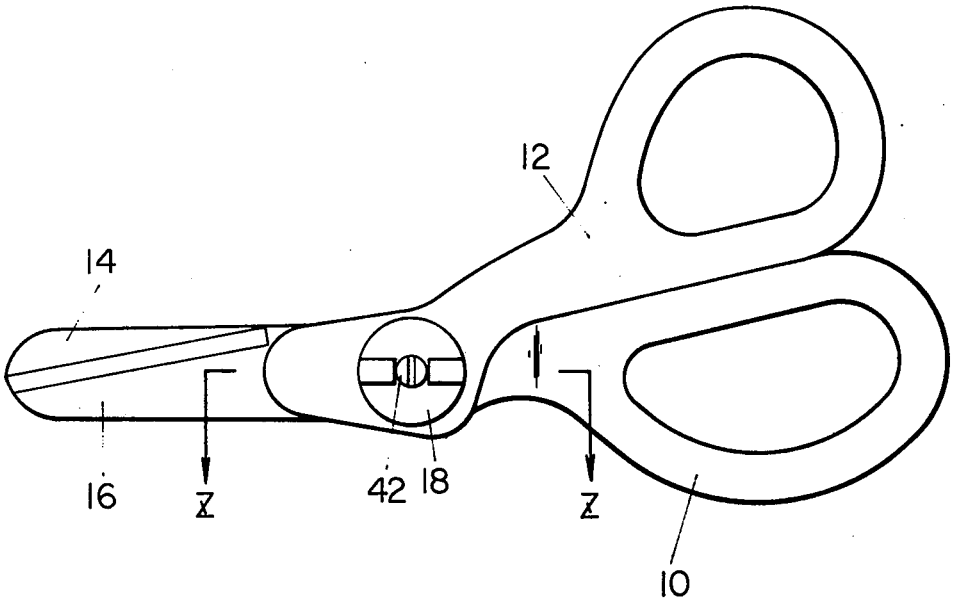
FIG. 1 is a frontal view of the shears of the present invention.
Figure 2:
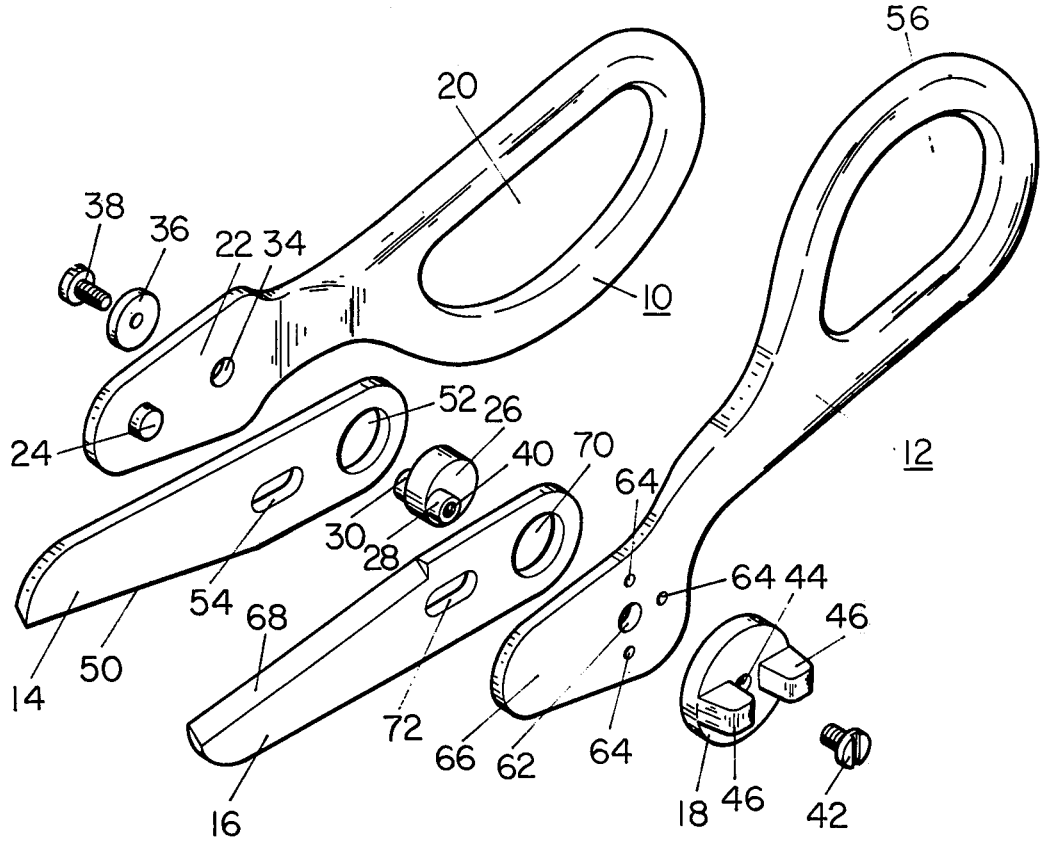
FIG. 2 is a perspective view of the shears in a disassembled condition.

As for the preferred embodiments of the present invention, in FIG. 2, the shears consists of a pair of handles 10, 12 and a pair of blade parts 14, 16 as the principal components. Two screws 38, 42 are arranged for fitting the blade parts 14, 16 between the handles 10, 12. Further, there is provided a cam to shift the angle between the blade parts 14, 16 and the handle and a knob 18 to operate the said cam 26.

The appearance of the handles 10 and 12 does not differ greatly from that of the handle of the well-known shears. However, the distinctive feature of the present invention is that the handle and the blade part are not integrated into one piece. Consequently, it is not necessary to use the same material for both the said handles 10, 12 and the blade parts 14, 16 because they can be manufactured separately. Therefore, there exist no special restrictions on selecting materials for the components of the shears as long as they can satisfy the function of the handle and blade parts. Accordingly, steel, stainless steel, hard plastics or even wood are satisfactory materials.

The handle 10 is provided with a finger hole 20 which is of the well-known type. A flat blade hold 22 of an approximately elliptical shape is formed in front of the said finger hole 20 and, then, a hole 34 is formed for inserting a projection of the cam 26 (which will be described hereinafter) on the same line as the projection 24.

The blade part 14 to be fitted on the blade hold 22 of handle 10 is made of steel or stainless steel separate from the handle 10. Therefore, when this blade part 14 is compared with a conventional one, it possesses the distinctive feature of having no handle parts. Namely, its entire shape is of an elongated rectangle with a blade edge 50 provided obliquely along one side. At the base portion thereof, a circular cam support hole 52 is formed to receive the cam 26 so that it fits the shape of the said cam 26 which is provided on the blade hold 22 of handle 10. Further, at the forward portion of the cam support hole 52, an elongated slide slot 54 is provided so as to support the projection 24 (which projects on handle 10) and slides the blade part 14 along the projection 24.

On the other hand, the blade part 16 to be attached to blade hold 66 of handle 12 matches the blade part 14. These two blade parts are constructed the same way except that the position of blade edge 68 is opposite to that of the other blade part when attached. At the base portion of the blade part 16, a cam support hole 70 is formed. Further, an elongated slide slot 72 is formed in front of the said cam support hole 70 and a projection 60 (provided on the handle 12) can be inserted thereinto.

As for handle 12, a finger hole 56 is formed which is similar to the finger hole 20 of the handle 10. On the forward part of handle 12, the oval-shaped flat blade hold 66 is provided and, on the center line thereof, the projection 60 (the height of which is about equal to the thickness of the blade part 16) is formed in front of the tip end of blade hold 66. Then, on the same center line as projection 60 and towards the finger hole 56, a hole 62 is formed to receive projection 28 provided on the cam 26 of handle 10. Moreover, around the said hole 62, three small dowel holes 64 are spaced at a definite distance on the same circumference opposite to the foregoing projection 60.

These dowel holes 64 are provided to engage a dowel 48 on the bottom side of the foregoing knob 18. A rotation of the knob 18 can be prevented by securely fitting the dowel 48 into one of the dowel holes while the said knob 18 is being turned.

Figure 3:
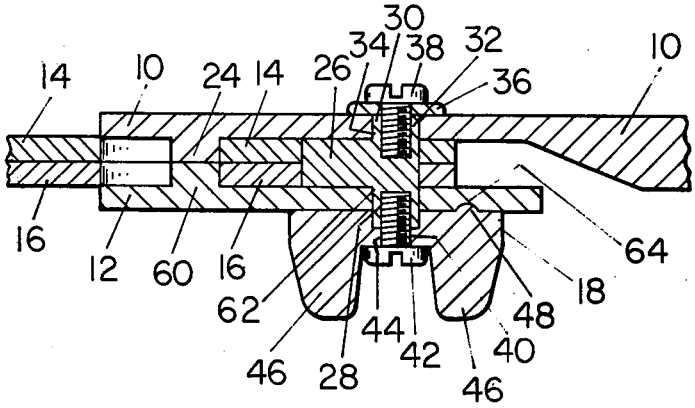
FIG. 3 is a longitudinal vertical sectional view looking in the direction of the line Z-Z marked with the arrows in FIG. 1.
Figure 4:
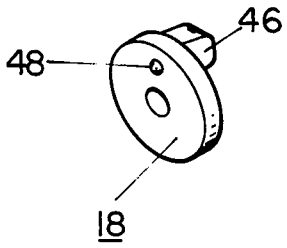
FIG. 4 is a perspective view of a knob installed on the handle base portion.

The thickness of the said cam 26 as shown in FIG. 3 is equal to the thickness of the two blade parts 14 and 16. On the surface of the cam 26, the projection 28 is formed away from the center thereof and its height is lower than the combined thickness of the blade hold 66 (of the handle 12) and the knob 18 as shown in FIG. 4. This will be explained in greater detail hereinafter.

In order to make the cam 26 rotatable on the handle 10, a projection is provided as shown in FIG. 3. This projection 30 is approximately the same thickness as the handle 10 which is on the opposite side of the foregoing projection 28. At the center of the said projection 30, a tapped hole 32 is provided for receiving a screw. Then, this projection 28 is inserted into hole 34 of the blade hold 22 (formed on the same line as projection 24 of the handle 10), making it protrude from the opposite side of the projection 28.

A washer 36 fits around projection 30 and screw 38 screws into the tapped hole 32 from the top of the washer 36. In order to hold the two blade parts 14 and 16 between the handles 10 and 12, a tapped hole 40 is formed at the center of the projection 28 (which projects from the cam 26) so that the screw 42 can be inserted thereinto. Then, a hole 44, which is located in a recess at the center of knob 18 and has symmetrically protruding parts 46 on its surface, is inserted into projection 28 of cam 26. The handles 10 and 12 and blade parts 14 and 16 are fitted together by attaching the said screw 42 into the tapped hole 40 of projection 28. Further, one small dowel 48 is provided on the bottom surface of the knob 18 which corresponds to dowel holes on the handle 12 (see FIGS. 3 and 4).

In order to assemble the shears of the present invention, the projection 30 of the cam 26 is inserted into the hole 34, provided on blade hold 22 of handle 10, and the screw 38 is fitted into the tapped hole 32 formed at the center of the said projection 30. This allows the cam to freely rotate on the blade hold 22 of handle 10. Then, after the blade edge 50 of the blade part 14 is turned inwardly, the slide slot 54 of the blade part 14 is inserted into the projection 24 of the handle 10. Also, the cam 26 of handle 10 fits into the cam support hole 52 of blade part 14. Further, having the blade edge 68 of blade part 16 facing the foregoing blade edge 50, the cam 26 is inserted into support hole 70 of the handle 10 and the inside surface of blade part 16 faces and fits to the surface of the blade part 14.

Now, the projection 60 of the handle 12 is held downward in the direction to which it protrudes and is inserted into the slide slot 72 provided on the foregoing blade part 16. At the same time, the projection 28 is fitted into hole 62 of handle 12 and the hole 44 of the knob 18. The screw 42 is inserted into the tapped hole 40 of projection 28, the knob 18 is fixed to the said projection 28 and, then, the two blade parts 14, 16 are held between the upper and lower handles 10 and 12.

When fixing the knob 18 around the projection 28, the dowel 48, which protrudes from the bottom side of knob 18, is fitted into any one of the three dowel holes 64 provided around the hole 62 through handle 12.

Figure 5:
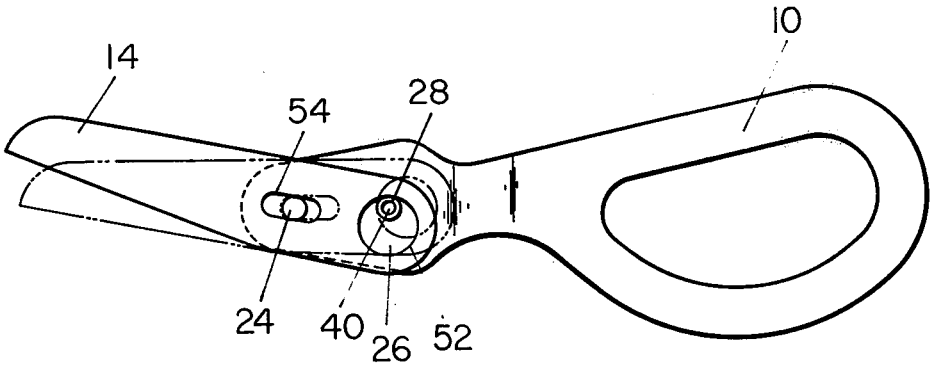
FIG. 5 is a frontal schematic view showing the actuation of a cam.

In order to manipulate the present shears, the knob 18 is revolved by grasping the protruded part 46 of the knob 18 with the finger and then, the cam 26 (connected thereto by screw 42) rotates. As shown in FIG. 5, the cam 26 moves eccentrically around the projection 28 which acts as a fulcrum. Therefore, the blade parts 14 and 16, which are fitted into cam 26 by the cam support holes 52 and 70, slide back and forth guided by the slide slots 54 and 72, respectively. At the same time, the base portion of the blade parts 14, 16 rotate in a circular arc by the revolution of the cam. Consequently, the angle between the blade parts 14 and 16 and the handle can be shifted within the range of 0°-20°.

Figure 6:
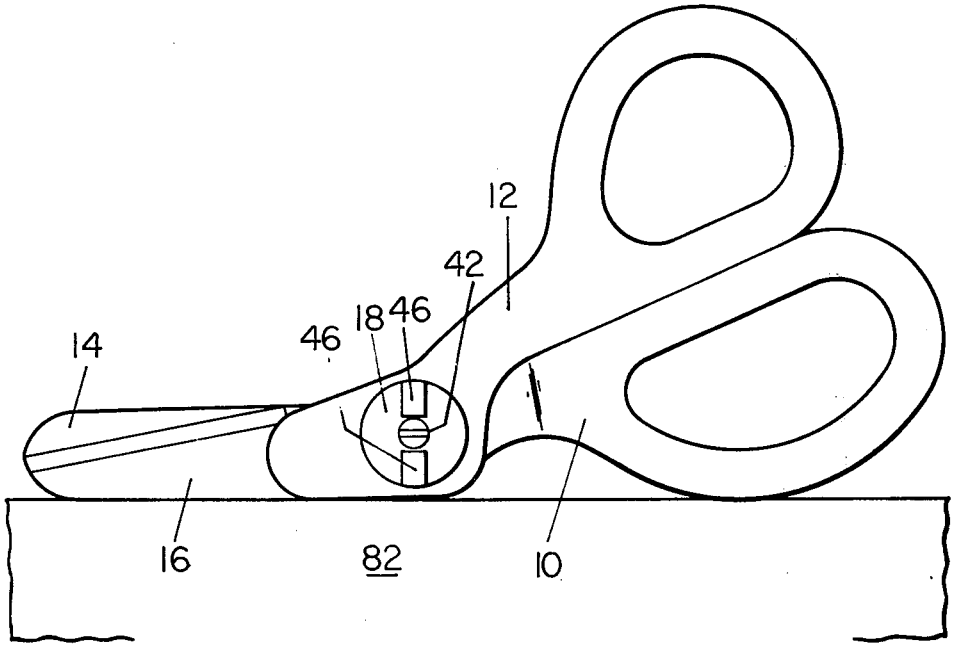
FIG. 6 is a frontal view of the shears for use on a cutting table.

Therefore, when the blade parts 14, 16 are shifted to the maximum, the inner sides of the blade part 14 and blade part 16 would, as shown in FIG. 6, move horizontally in the direction of the inner sides of handles 10 and 12. Thus, under the conditions just described, fabrics, paper and the like (not illustrated herein) which are laid widely and horizontally on a cutting table 82, can be cut by operation of the handle 10 and the handle 12 along the surface of the cutting table 82.

The present invention as described above, has a simple construction which makes it easy to manipulate and can be manufactured at a low cost. It has a special feature in that the handle and the blade part can be independently manufactured which makes it unnecessary to produce an expensive steel or stainless handle. Moreover, the angle between the blade part and the handle can be freely changed by simple adjustment of the knob. Consequently, the blade part can be adapted to any article to be cut so that the cutting can be performed easily and securely. Further, the shifting of the angle between the handle and the blade part requires no skill or manual dexterity.

What is claimed is:

1. A shears comprising a pair of handles, a pair of blades and a circular and rotatable cam containing projections eccentrically located on both sides thereof, holes located on the upper part of each of the blades to receive the cam, holes located on each of the blade-holding portions of the handles to receive the cam projections, wherein the pair of handles and blades are held together and operated by means of said circular and rotatable cam in such a manner that the cam is sandwiched between the blades and fits into said receiving holes of the upper portions of the blades and wherein the handles are then fitted onto the projections located on both sides of the cam, and a knob lined up with the cam-projection receiving hole of one of the handles such that the angle between the handles and the blades may be changed by rotation of the cam.

2. A shears comprising a pair of handles, a pair of blades, a circular and rotatable cam containing projections eccentrically located on both sides thereof, holes located on the upper part of each of the blades to receive the cam, holes located on each of the blade-holding portions of the handles to receive the cam projections, wherein the pair of handles and blades are held together and operated by means of said circular and rotatable cam in such a manner that the cam is sandwiched between the blades and fits into said receiving holes of the upper portions of the blades and wherein the handles are then fitted onto the projections located on both sides of the cam, said handles further containing projections in juxtaposition to the projection receiving holes on the blade-holding portions thereof, slide slots located on the upper portion of the blades in juxtaposition to the cam-receiving holes, a knob located containing a hole in the center thereof, and lined up with the cam projection-receiving hole of one of the handles, a screw which fits into the hole of the knob into one of the projections located on the cam and secures the knob to the cam, a second screw which fits into the other cam projection, said screws functioning by securing the handles and blades together so that they can be activated by the rotatable cam.

3. A shears as claimed in claim 2, wherein a dowel is located on the bottom side of the knob facing one of the handles and dowel holes are formed on the blade hold part of the handle opposite to the dowel.

* * * * *